United States Patent [19]

Southern et al.

[11] 4,175,921

[45] Nov. 27, 1979

[54] APPARATUS FOR REMOVING GASES FROM PARTICLES

[75] Inventors: Raymond L. Southern, Lower Burrell; Orville W. Reen, New Kensington, both of Pa.

[73] Assignee: Allegheny Ludlum Industries, Inc., Pittsburgh, Pa.

[21] Appl. No.: 881,203

[22] Filed: Feb. 27, 1978

Related U.S. Application Data

[62] Division of Ser. No. 749,958, Dec. 13, 1976, abandoned.

[51] Int. Cl.[2] ..... C21D 9/00

[52] U.S. Cl. ..... 432/261; 220/408; 220/469; 34/237

[58] Field of Search ..... 220/19, 20, 4 F, 441, 220/442, 447, 83, 408, 409, 469; 432/13, 14, 253, 254, 261; 75/0.5 BA, 130.5; 148/126; 266/148, 149; 34/237; 23/264

[56] References Cited

U.S. PATENT DOCUMENTS

| | | | |
|---|---|---|---|
| 252,883 | 1/1882 | Lindner et al. | 220/409 |
| 903,918 | 11/1908 | Thrower | 220/447 |
| 1,794,151 | 2/1931 | Cope | 432/261 |
| 1,811,566 | 6/1931 | Scott | 220/408 |
| 2,534,286 | 12/1950 | Maitzen | 220/409 |
| 2,661,889 | 12/1953 | Phinney | 220/441 |
| 3,074,583 | 1/1963 | Martinich, Jr. | 220/408 |
| 3,642,263 | 2/1972 | Pine et al. | 432/261 |
| 4,011,347 | 3/1977 | Griffith | 220/441 |

*Primary Examiner*—John J. Camby
*Assistant Examiner*—Larry I. Schwartz
*Attorney, Agent, or Firm*—Vincent G. Gioia; William J. O'Rourke, Jr.

[57] ABSTRACT

Gases are removed from particles, such as ferrochrome, by providing a container having an open top and a vertical wall having closely spaced opening therein so constructed that the particles will not plug or pass therethrough. Preferably a central vertical tubular member is provided in the container with similar holes. The particles are placed in the container between its wall and the vertical member and heated in a furnace to a temperature at which the gases will evolve. The gases may be removed by having the furnace under vacuum or by the atmosphere in the furnace.

2 Claims, 5 Drawing Figures

APPARATUS FOR REMOVING GASES FROM PARTICLES

This is a division of appication Ser. No. 749,958 filed Dec. 13, 1976 now abandoned.

This invention relates to a method and apparatus for removing gases from particles and particularly to removing nitrogen and the like from ferrochrome. The term particles as referred to herein means pieces of such size and shape that they cannot readily be piled one upon the other to form a pile having relatively vertical sides. For example, granular material such as sand, gravel and ores, or spherical objects are such particles. In order to remove the gases the particles must be heated in a furnace and if, merely piled therein, only a relatively small amount of material can be charged on the furnace hearth or on a tray since the pile will assume a generally conical shape. We have found that when an ordinary container is used the heating is relatively slow and the gas removal also relatively slow and non-uniform. In removing gases from materials the heating may be done in a hydrogen or other atmosphere such as disclosed in Brickner et al U.S. Pat. No. 3,277,149 dated Oct. 4, 1966. In this case the evolved gases will be removed by the hydrogen or other atmosphere. In removing gases such as nitrogen, carbon, hydrogen, etc. from ferrochrome the ferrochrome is generally heated in a vacuum furnace such as disclosed in U.S. Patents Khitrik No. 3,523,021 dated Aug. 4, 1970, Chadwick No. 3,725,051, dated Apr. 3, 1973, Takeda No. 3,746,584 dated July 17, 1973 and Muscatell No. 3,788,836, dated Jan. 29, 1974. The rate of removal of nitrogen and other gases from a metal in this case is a function of metal temperature, the time at the temperature and the distance the evolved gases must travel to the outside of the charge. We have proven by tests that treatment of 6000 lbs of ferrochromium in a container open only at its top resulted in non-uniform temperatures throughout the charge, excessive heating time and relatively wide variations in nitrogen content in various locations in the charge. We have also found that the time for removal of nitrogen from a given ferrochromium particle is a function of the distance which it must travel through the charge to the highest vacuum atmosphere. During the de-nitrification process, the ferrochromium particles closest to the highest vacuum atmosphere are the first to lose nitrogen. As the process continues, those particles next closest to the high vacuum atmosphere are de-nitrified. The evolved nitrogen from these particles, however, passes over the first de-nitrified ferrochromium particles creating a partial pressure of nitrogen around these particles. Eventually, the ferrochromium particles in the charge which are the greatest distance from the high vacuum atmosphere evolves its nitrogen and the nitrogen content of the charge reaches an equilibrium value.

It is therefor an object of our invention to provide a method of heating and removing evolved gases from a charge of particles efficiently and relatively uniformly.

Another is to provide such a method in which a ferrochrome charge is heated uniformly at a rapid rate and the evolved gases rapidly removed by means of a vacuum.

Still another object is to provide apparatus for heating and removing evolved gases from a charge of particles efficiently and relatively uniformly.

A still further object is to provide such apparatus which enables rapid and uniform heating of a charge in a vacuum furnace.

These and other objects will be more apparent after referring to the following specification and drawings in which.

Figure 2:
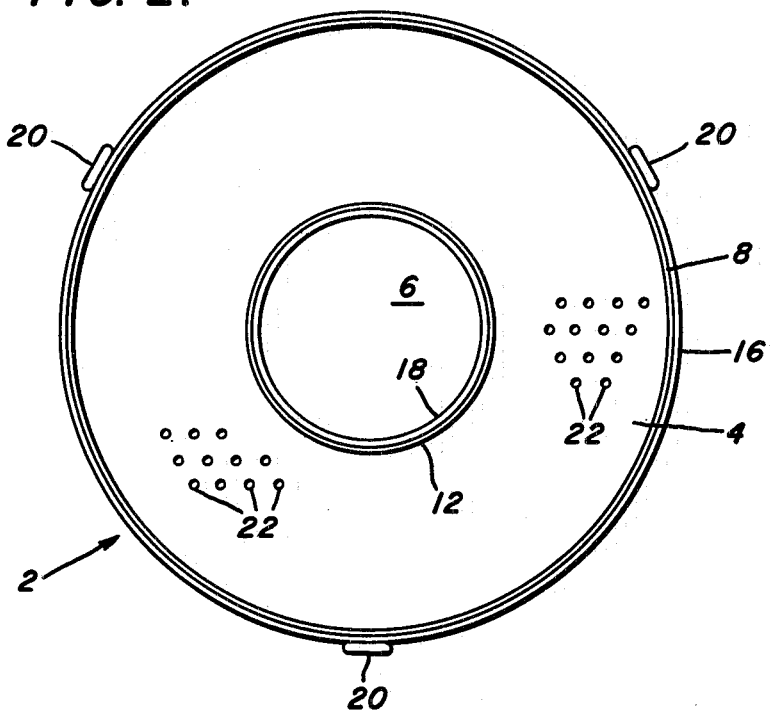
FIG. 2 is a top plan view of FIG. 1.
Figure 1:
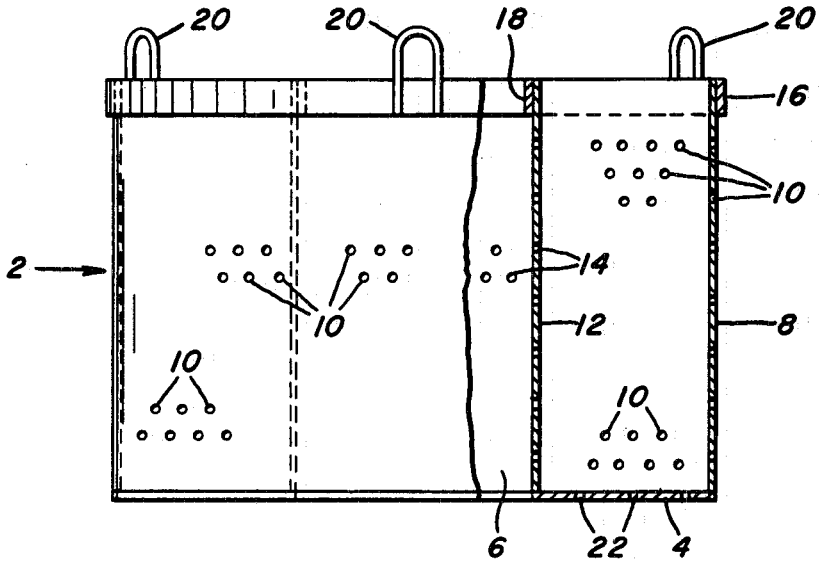
FIG. 1 is an elevation of one container of our invention with parts broken away and shown in section.

Referring more particularly to FIGS. 1 and 2 of the drawings, reference numeral 2 indicates a container preferably made of low carbon steel and having a bottom 4 with a central opening 6, a peripheral wall 8 having a plurality of closely spaced holes 10 therein, a central tubular member 12 having a plurality of closely spaced holes 14 therein, reinforcing bands 16 and 18 around wall 8 and member 12, respectively and lifting lugs 20 welded to the band 16. All parts are preferably welded together. The holes 10 and 14 are of such size that the particles of ferrochrome or the like contained therein will not plug or pass through the openings. If desired, holes 22 similar to holes 10 and 14 may be provided in bottom 4. In one particular embodiment the bottom 4 is made of ½ inch plate having a 52 inch diameter with a 20 inch central hole 6, the side wall and member 12 are made of ⅛ inch plate with 1/16 inch diameter holes at 3/16 inch staggered centers and the member 12 has a 20 inch inside diameter.

Figure 4:
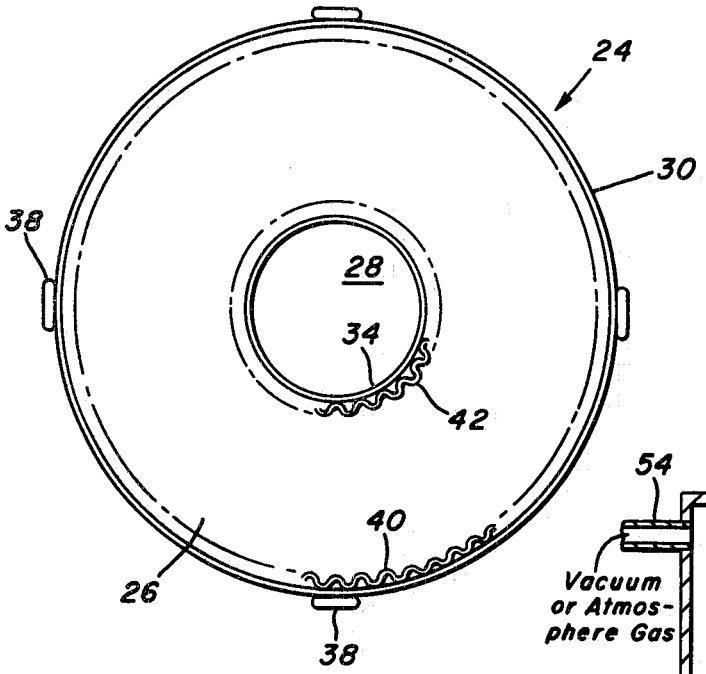
FIG. 4 is a top plan view of FIG. 3.
Figure 5:
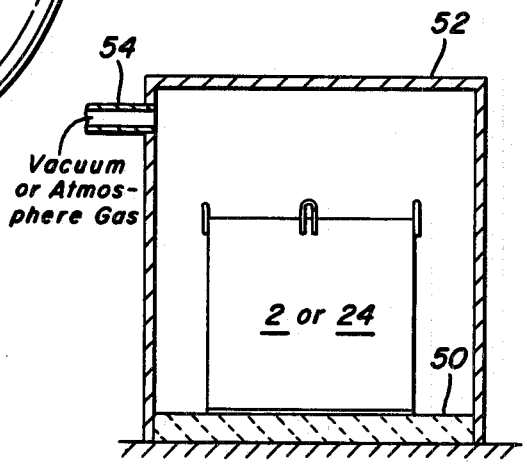
FIG. 5 is a schematic view of a furnace with a charge therein.
Figure 3:
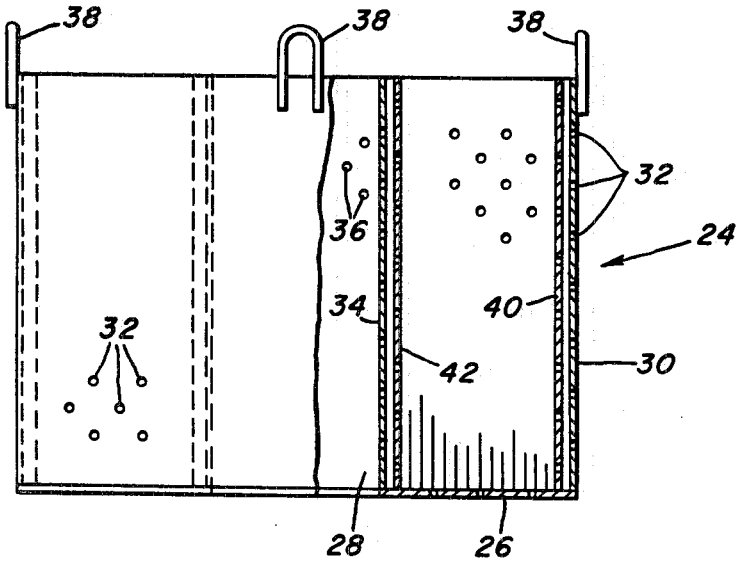
FIG. 3 is a view, similar to FIG. 1 showing a second embodiment of our invention.

FIGS. 3 and 4 show a second embodiment of our invention wherein reference number 24 indicates a container similar to container 2. Like container 2 it has a bottom 26 with a central opening 28, a peripheral wall 30 with a plurality of closely spaced holes 32 therein, a central tubular member 34 with a plurality of closely spaced holes 36 therein, and lifting lugs 38. In one specific embodiment the container 24 is made of low carbon steel with the bottom being ½ inch thick and the wall 30 and member 34 being ¼ inch thick. The holes 32 and 36 were ¼ inch and ⅛ inch diameters respectively on two inch and one inch staggered centers, respectively. The wall 30 is lined with a perforated corrugated steel sheet 40 and the member 32 surrounded by a similar sheet 42 to prevent clogging of the holes 32 and 36. Holes 1/16 inch in diameter are provided in sheets 40 and 42 on 3/16 inch staggered centers. In the alternative a 14 mesh steel screen may be used in place of sheets 40 and 42. If desired a similar corrugated sheet may be provided on the bottom of the container. Also in this embodiment the holes 32 and 36 may be omitted with the evolved gases passing through the holes in the corrugated sheets 40 and 42 to the surrounding atmosphere (vacuum or hydrogen) through the space between the corrugated sheets and adjacent walls. Alternatively, in this embodiment, the holes 32 and 36 may be of a larger diameter than that of the particles.

It will be seen that the outer wall may be formed of a single member having holes therethrough or of an outer member having a smooth inner surface and a corrugated sheet adjacent the smooth inner surface having holes therein. The outer member in the later case may or may not have holes therethrough. Likewise the wall of the tubular member may be formed of a single member having holes therethrough or of an inner member having a smooth outer surface and a corrugated sheet adjacent the smooth outer surface having holes therein. The inner member in the later case may or may not have holes therethrough.

In the practice of our invention the container 2 or 24 is filled with ferrochrome or other particles outside the tubular center member and the loaded container placed on hearth 50 of a furnace 52 having connection 54 to a source of vacuum or atmosphere gas. Such furnaces are conventional so that they need not be shown or described in detail. In case holes are provided in the bottom the container will be raised from the surface of the hearth to better permit escape of evolved gases. The furnace is then heated to evolve the gases and remove them from the charge.

A charge of ferrochrome was treated in container 2 as follows: A 7000 lb. charge was placed in a cold furnace which was then evacuating. The furnace was then heated to a temperature of 2250° F. in a hydrogen atmopshere at which time the center of the load was at approximately 1680° F. The furnace was maintained at 2250° F. for 23½ hours with the hydrogen atmosphere being maintained for 12 hours at which time the center of the load was at a temperature 2200° F. The furnace was then evacuating and the pumping was continued until a vacuum of 100 microns was reached which required 11½ hours. At the end of the 23½ hour heating time the furnace was cooled at 100° F. per hour until about 400° F. and then to drop-out temperature with the circulation pump running at full speed, the entire cooling time amounting to 30 hours.

Our method and apparatus has been effective in reducing the total time to remove the nitrogen and results in more uniform reduction of nitrogen throughout the charge.

While several embodiments have been shown and described in detail, it will be readily apparent to those skilled in the art that various adaptations and modifications may be made within the scope of the invention.

I claim:

1. An apparatus for removing gases from particles in a heating furnace, the improvement comprising a cylindrical container for said particles; said container including a peripheral vertical wall, a bottom for supporting said particles, a vertical, cylindrical tubular member located centrally in said container, and an open top, wherein the peripheral wall of said container includes an outer member having a smooth inner surface and a corrugated sheet adjacent said inner surface extending completely around the periphery, and said tubular member includes an inner member having a smooth outer surface and a corrugated sheet adjacent said outer surface extending completely around the periphery, both of said corrugated sheets having closely spaced openings therein constructed of less diameter than said particles, such that the particles will not plug or pass therethrough while evolved gases will pass through the openings to the surrounding atmosphere.

2. An apparatus for removing gases from particles in a heating furnace, the improvement comprising a container for said particles, said container including an outer peripheral vertical wall, said wall having two layers with at least the majority of the inner layer, with respect to the particle area, spaced from the outer layer, said inner layer having openings therein around the periphery thereof, and a vertical tubular member located centrally in said container including two layers with at least the majority of the inner layer, with respect to the particle area, spaced from the outer layer, said inner layers having openings therein around the periphery thereof so constructed that the particles will not plug or pass therethrough while evolved gases will pass through the openings to the surrounding atmosphere.

* * * * *